US006006686A

United States Patent [19]

Hamajima

[11] Patent Number: 6,006,686

[45] Date of Patent: Dec. 28, 1999

[54] SEWING AND EMBROIDERING MACHINE SYSTEM CAPABLE OF CHANGING DISPLAY IMAGE DURING EACH STITCHING OPERATION

[75] Inventor: Eiichi Hamajima, Nagoya, Japan

[73] Assignee: Brother Kogyo Kabushiki Kaisha, Nagoya, Japan

[21] Appl. No.: 09/145,274

[22] Filed: Sep. 2, 1998

[30] Foreign Application Priority Data

Sep. 11, 1997 [JP] Japan ..... 9-267839

[51] Int. Cl.[6] ..... D05B 21/00; D05C 5/02

[52] U.S. Cl. ..... 112/102.5; 112/475.19; 364/470.09

[58] Field of Search ..... 112/102.5, 475.19, 112/470.06, 470.01, 470.04, 454, 456, 457, 458, 445; 364/470.09

[56] References Cited

U.S. PATENT DOCUMENTS

| | | | |
|---|---|---|---|
| 4,301,753 | 11/1981 | Meier | 112/470.04 |
| 4,901,656 | 2/1990 | Yoshida | 112/445 X |
| 5,050,513 | 9/1991 | Frankel | 112/470.02 |
| 5,156,107 | 10/1992 | Kyono et al. | 112/445 |
| 5,228,403 | 7/1993 | Sugimoto | 112/102.5 |
| 5,361,714 | 11/1994 | Hartwig | 112/445 |
| 5,752,458 | 5/1998 | Morita | 112/445 X |
| 5,782,189 | 7/1998 | Hirata et al. | 112/445 X |

FOREIGN PATENT DOCUMENTS

| | | |
|---|---|---|
| 1-139094 | 5/1989 | Japan . |
| 3-173598 | 7/1991 | Japan . |
| 3-237990 | 10/1991 | Japan . |
| 4-109988 | 4/1992 | Japan . |
| 5-42267 | 2/1993 | Japan . |
| 5-42268 | 2/1993 | Japan . |
| 6-13767 U | 2/1994 | Japan . |
| 7-39662 | 2/1995 | Japan . |
| 7-51474 | 2/1995 | Japan . |

*Primary Examiner*—Peter Nerbun
*Attorney, Agent, or Firm*—Oliff & Berridge, PLC

[57] ABSTRACT

A ROM built in a controller is provided with a guide information memory storing information display data for displaying information about methods of operating an embroidery device, and an additional information memory storing additional information display data for displaying additional information, such as information to be displayed during a stitching operation. A ROM included in an external ROM card is provided with a guide information memory storing guide information about the latest embroidery patterns and optionally available devices. During an embroidering operation for embroidering each of component color sections of an embroidery pattern, ordinary information to be displayed during a stitching operation is displayed on a display, and a plurality of images illustrating pieces of guide information about the latest embroidery patterns and optionally available devices are displayed sequentially at predetermined intervals to provide the operator with the latest information and to avoid boring the operator during the embroidering operation.

26 Claims, 11 Drawing Sheets

SEWING AND EMBROIDERING MACHINE SYSTEM CAPABLE OF CHANGING DISPLAY IMAGE DURING EACH STITCHING OPERATION

CROSS REFERENCE TO RELATED APPLICATION

This application relates to and incorporates herein by reference Japanese Patent Application No. 9-267839 filed on Sep. 11, 1997.

BACKGROUND OF THE INVENTION

1. Field of the Invention

The present invention relates to a sewing and embroidering machine system. More particularly, the present invention relates to a sewing and embroidering machine system capable of sequentially displaying pieces of guide information including a method of operating an embroidery system during each stitching operation.

2. Description of Related Art

A conventional electronically controlled sewing and embroidering machine for home use comprises a stitching mechanism which includes a needle driven for vertical reciprocation and a looper for forming a loop in cooperation with the needle, an embroidery frame driving mechanism for moving an embroidery frame detachably holding a workpiece (cloth) in two perpendicularly intersecting directions, a pattern data storage storing pattern data of a plurality of patterns such as vehicles, flowers and animals, a display, and a control panel. When the operator manipulates the control panel to display a desired embroidery pattern on the display for pattern selection and to make the sewing machine stitch the selected embroidery pattern, the driving mechanism is controlled on the basis of the pattern data of the selected embroidery pattern. The driving mechanism and the stitching mechanism cooperate to stitch the selected embroidery pattern in a plurality of colors on the workpiece held on the embroidery frame.

During the embroidering operation using a plurality of color threads to stitch a colorful embroidery pattern, stitching information about the embroidering operations including a plurality of component color sections to be embroidered respectively with the plurality of color threads, and time necessary to embroider the component color sections of the embroidery pattern in which the embroidering operation is in progress is displayed in addition to the selected pattern on the display. Upon each completion of forming stitches in one of the component color sections of the embroidery pattern, the stitching operation is stopped and the information displayed on the display is changed to display information about operations for forming stitches in the next component color section of the embroidery pattern. This necessitates the operator to watch the information displayed on the display continually, to check the pattern being stitched, and to confirm that the thread is not broken, i.e., to confirm that the stitching operation is not interrupted.

When embroidering a component color section of an embroidery pattern selected from the plurality of component color sections of the embroidery patterns, the stitching operation is stopped and information displayed on the display changes each time the stitching operation for embroidering the component color section pattern is completed. However, as long as the stitching operation for embroidering the same component color section pattern continues, substantially the same information is displayed continuously on the display for a long period, e.g., ten or fifteen minutes, thus boring the operator.

SUMMARY OF THE INVENTION

Accordingly, it is an object of the present invention to provide a sewing and embroidering machine, which is capable of sequentially displaying a plurality of display frames showing pieces of guide information on a display during an embroidering operation to avoid boring the operator and to enable the operator to enjoy embroidering.

According to the present invention, stitching information to be displayed during an embroidering operation is stored in a first data storage area, and guide information about embroidering is stored in a second data storage area. A display control unit reads the stitching information from the first storage area during an embroidering operation to embroider a pattern of a color, and displays the stitching information on a display. Then, the display control unit reads the guide information from the second data storage area, and displays the guide information instead of the stitching information on the display. Thus the stitching information is changed to the guide information during the embroidering operation to avoid boring the operator during the embroidering operation and to enable the operator to enjoy the stitching time.

Preferably, information about a method of operating an embroidering mechanism and information about new embroidery patterns is displayed subsequent to the display of the ordinary stitching information. Therefore, the operator is enabled to acquire knowledge of using the embroidering mechanism easily and effectively without reading an operation manual book and to find out the latest patterns.

Preferably, pieces of the guide information divided into a plurality of display frames and read from the second data storage area are displayed sequentially one at a time and each of the pieces of the guide information is displayed for a first predetermined time period, for example, in the range of 10 to 15 seconds. The operator is thus enabled to acquire many pieces of guide information without being bored while the sewing machine is in embroidering operation, and is enabled to enjoy the stitching time.

Preferably, the stitching information about ordinary stitching operation is displayed for a second predetermined time period, for example, in the range of 15 to 20 seconds after an embroidering operation using each thread of each color has been started. Thus, the operator is enabled to acquire many pieces of stitching information about an embroidering operation using the thread of the same color, including the stitching time and the color of the thread.

Preferably, the guide information is cleared from the display and the stitching information is displayed again for a third predetermined time period, for example, in the range of 15 to 20 seconds, before an embroidering operation using the thread of the same color is completed. Thus, it is informed to the operator that the embroidering operation using the thread of the same color will be terminated soon, and that another color thread for embroidering the next component color section should be prepared beforehand.

Preferably, the sewing machine is capable of using an external memory storing pattern data of a plurality of patterns and of embroidering a pattern selected from the plurality of patterns. Guide information is read from the second data storage area included in the external memory and the read guide information is displayed. The latest guide information can be displayed and obtained every time a new external memory is procured.

BRIEF DESCRIPTION OF THE DRAWINGS

Other objects, features and advantages of the present invention will become more apparent from the following detailed description made with reference to the accompanying drawings. In the accompanying drawings.

DETAILED DESCRIPTION OF THE PREFERRED EMBODIMENTS

Figure 1:
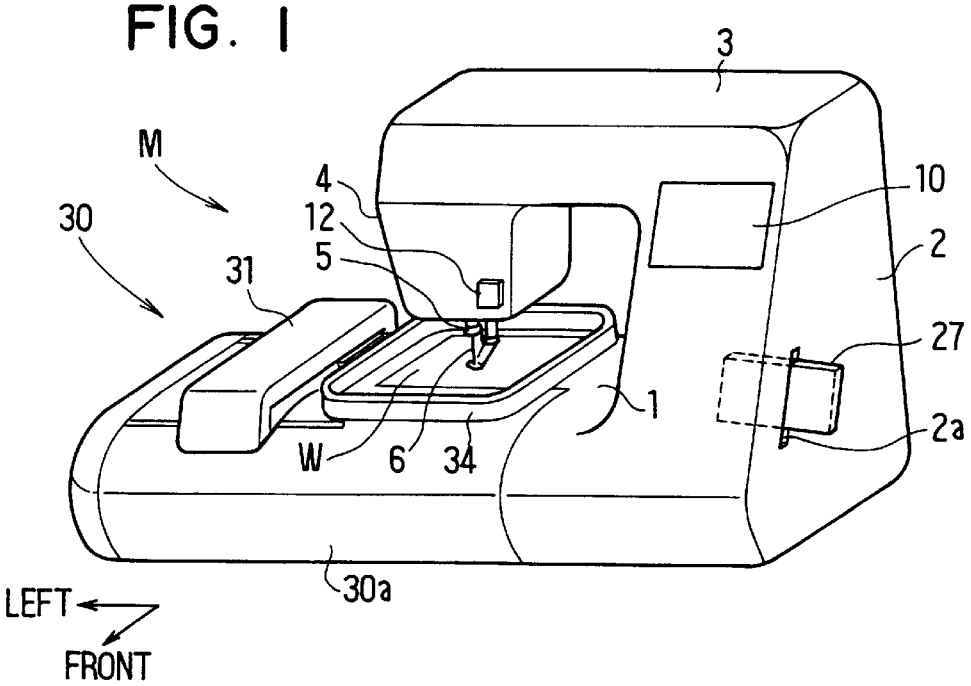
FIG. 1 is a perspective view of an electronically controlled sewing and embroidering machine according to a preferred embodiment of the present invention.

In a preferred embodiment of the invention, as shown in FIG. 1, an electronically controlled sewing and embroidering machine M is constructed by a sewing machine to which an embroidering device 30 is detachably attached. The machine M has a bed 1, a column 2 rising from the right end of the bed 1, and an arm 3 horizontally extending over the bed 1 from the upper end of the column 2.

Figure 2:
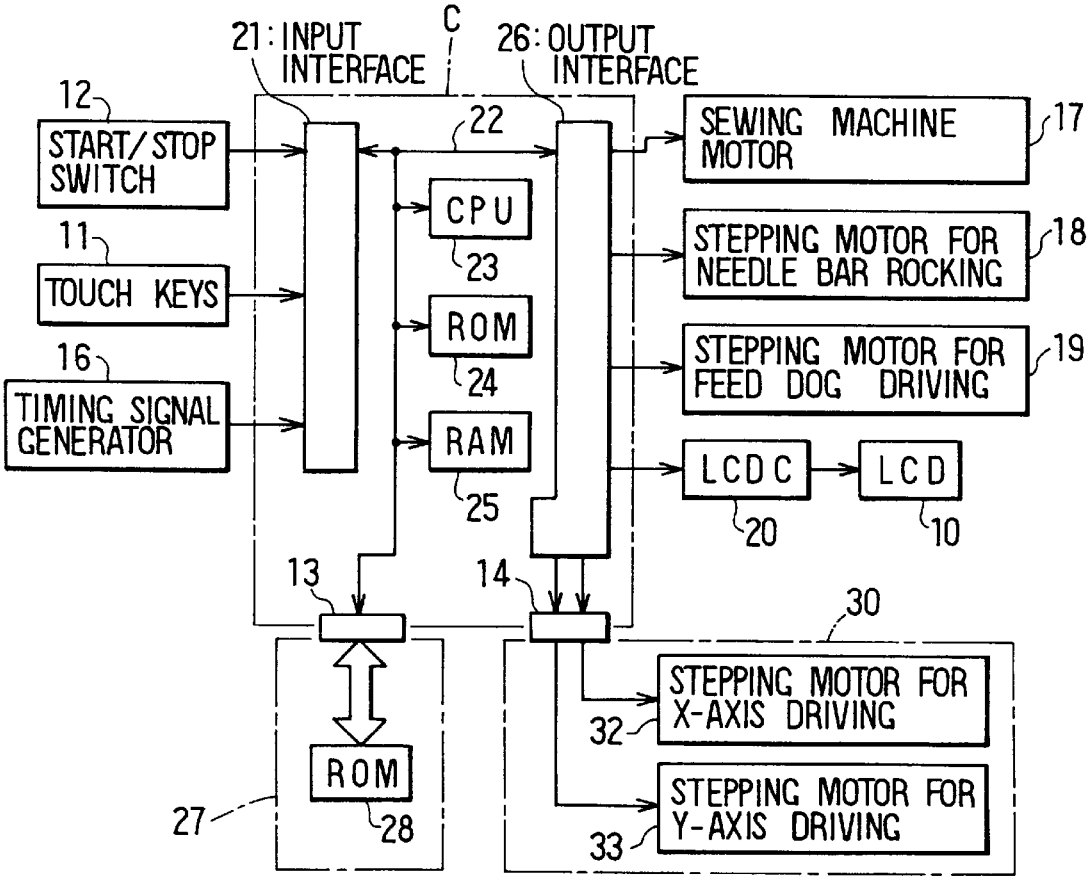
FIG. 2 is a block diagram of an electronic control system in the machine shown in FIG. 1.

Arranged on the bed 1 are a vertical feed dog driving mechanism (not shown) for driving a feed dog up and down, a horizontal feed dog driving mechanism (not shown) for driving the feed dog back and forth, and a thread loop taking device (a horizontally rotating shuttle) containing a bobbin and capable of stitching in cooperation with a sewing needle 6. The column 2 is provided with a card slot 2*a* for a ROM (read-only memory) card 27. The ROM card 27 stores therein pattern data (stitching data and pattern displaying data) of optionally selectable embroidery patterns. That is, the ROM card 27 is used as an external memory serving as a data storage medium for storing various pattern data and is inserted in the card slot 2*a* to be connected to an internal card connector 13 (FIG. 2).

Arranged on the arm 3 are a needle bar driving mechanism for driving a needle bar 5 holding the needle 6 at its lower end for a vertical motion, a needle bar rocking mechanism (not shown) for driving the needle bar 5 for a rocking motion in directions perpendicular to a workpiece (cloth) feed direction, and a thread take-up lever driving mechanism for driving a thread take-up lever for a vertical motion in synchronism with the vertical motion of the needle bar 5. The vertical feed dog driving mechanism, the needle bar driving mechanism and the thread take-up lever driving mechanism are driven by a main motor or sewing machine motor 17 (FIG. 2). The needle bar rocking mechanism is driven by a stepping motor 18 (FIG. 2), while the horizontal feed dog driving mechanism is driven by a stepping motor 19 (FIG. 2). A start/stop switch 12 for starting a stitching operation and stopping the stitching operation is attached to a head 4 combined with the arm 3.

A large liquid crystal display (LCD) 10 is embedded in the front wall of the arm 3 to display visually sewing stitches, embroidery patterns, designations of functions and/or messages. Touch keys 11 having transparent electrodes are arranged in rows and columns on the front surface of the liquid crystal display 10 so as to correspond to the embroidery patterns and the designations of functions, respectively. Desired embroidery patterns and desired functions can be selected by operating the corresponding touch keys 11.

The embroidery device 30 is detachably mounted on a free bed part (free arm) which is provided at the left end part of the bed 1. The embroidery device 30 comprises a main case 30*a*, an embroidery frame 34 for detachably holding a workpiece W, an embroidery frame holding unit 31 internally provided with a Y-axis driving mechanism for driving the embroidery frame 34 for a Y-axis motion, i.e., a back-and-forth motion, and capable of holding the embroidery frame 34, and an X-axis driving mechanism contained in the main case 30*a* and capable of driving the embroidery frame holding unit 31 and the Y-axis driving mechanism included in the embroidery frame holding unit 31 for an X-axis motion, i.e., a left-and-right motion. The X-axis driving mechanism is driven by a first stepping motor 32 (FIG. 2), while the Y-axis driving mechanism is driven by a second stepping motor 33 (FIG. 2).

With the embroidery device 30 being mounted on the free bed part, the first stepping motor 32 and the second stepping motor 33 are connected electrically through a connector 14 to a controller C included in the machine M. The controller C controls the first stepping motor 32 and the second stepping motor 33 to drive the embroidery frame 34 holding the workpiece W for the X-axis motion and the Y-axis motion for embroidering. The embroidery device 30, the needle bar driving mechanism, the take-up lever driving mechanism and the associated mechanisms constitute an embroidery system.

As shown in FIG. 2, the controller C, i.e., a stitching control unit, comprises an input interface 21, a computer including a CPU 23, a ROM 24 and a RAM 25, an output interface 26, and a common bus 22 interconnecting those components.

The start/stop switch 12, the touch keys 11, and a timing signal generator 16 capable of sensing angular positions of a main shaft included in the machine M are connected to the input interface 21. The sewing machine motor 17, the stepping motor 18, the stepping motor 19, a liquid crystal display controller (LCDC) 20 for controlling the liquid crystal display (LCD) 10, and the connector 14 for connection with the stepping motors 32 and 33 of the embroidery device 30 are connected to the output interface 26. A ROM 28 included in the ROM card 27 is connectable to the common bus 22 through the connector 13.

The ROM 24 stores therein, a general control program for controlling sewing operations for stitching practical patterns and for controlling the display 10; a control program for controlling operations for selecting, editing and stitching a selected embroidery pattern, including an editing procedure for specifying the size and position of a selected embroidery pattern through the display 10 and a stitching operation for stitching the selected embroidery pattern; and a control program for controlling a screen display.

Figure 3:
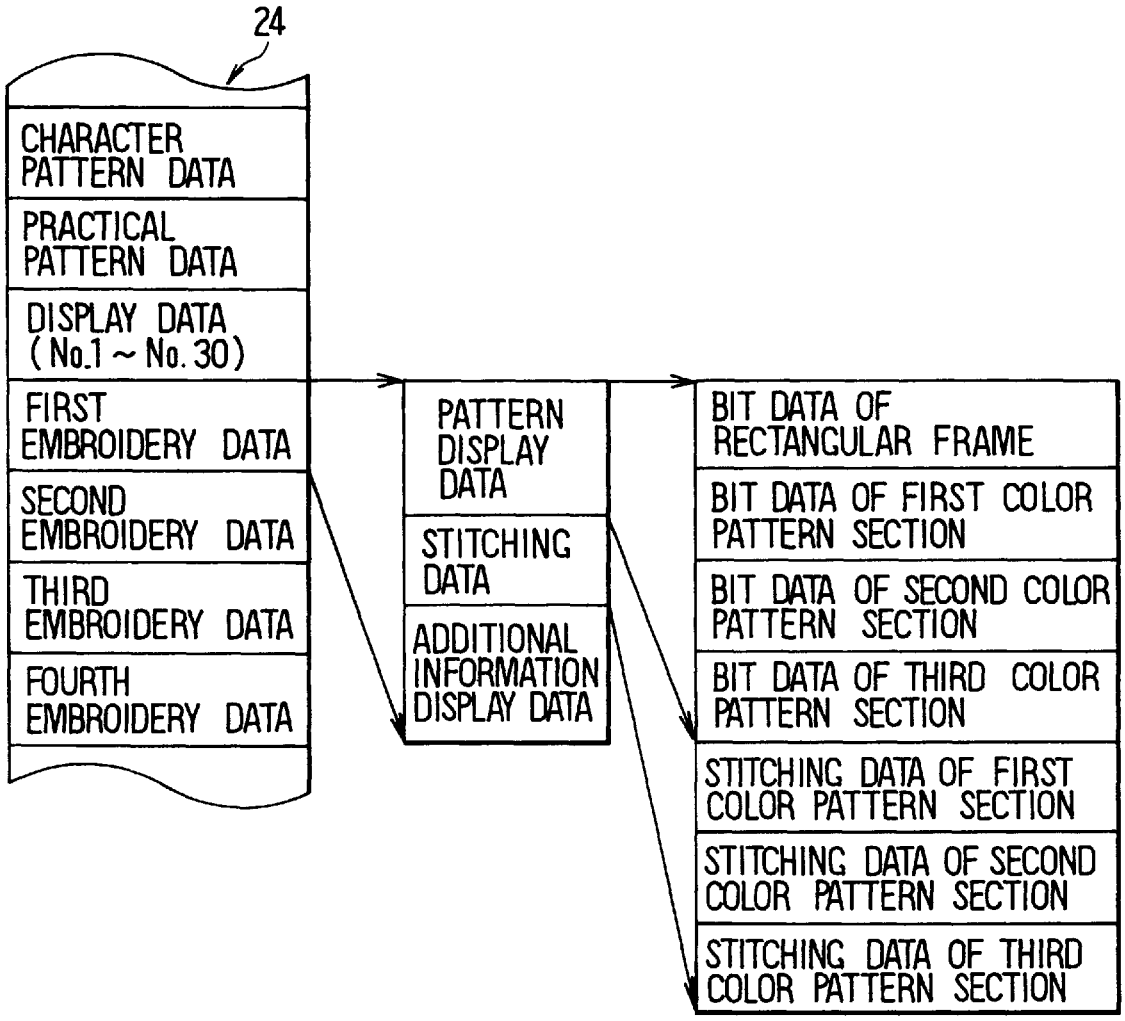
FIG. 3 is a schematic view showing the structure of data stored in a ROM in the control system shown in FIG. 2.

As shown in FIG. 3, the ROM 24 further stores in its different storage areas various data including character pattern data including display data for displaying numerals and alphabets to be selected and stitching data for stitching the numerals and characters; practical pattern data including display data for displaying a plurality of patterns to be selected and stitching data for stitching the practical patterns; display data (guide information) containing thirty display frames (No. 1 frame to No. 30 frame) on a method of operating the machine M; and pattern data of relatively frequently used embroidery patterns (a first embroidery pattern, a second embroidery pattern, a third embroidery pattern, . . . , and an n-th embroidery pattern). The pattern data of the plurality of embroidery patterns is classified into groups by the types of embroidery patterns, and pattern numbers are assigned to the embroidery patterns, respectively. A display data area storing display data of information about the method of operating the machine M constitutes one display data memory.

Figure 12:
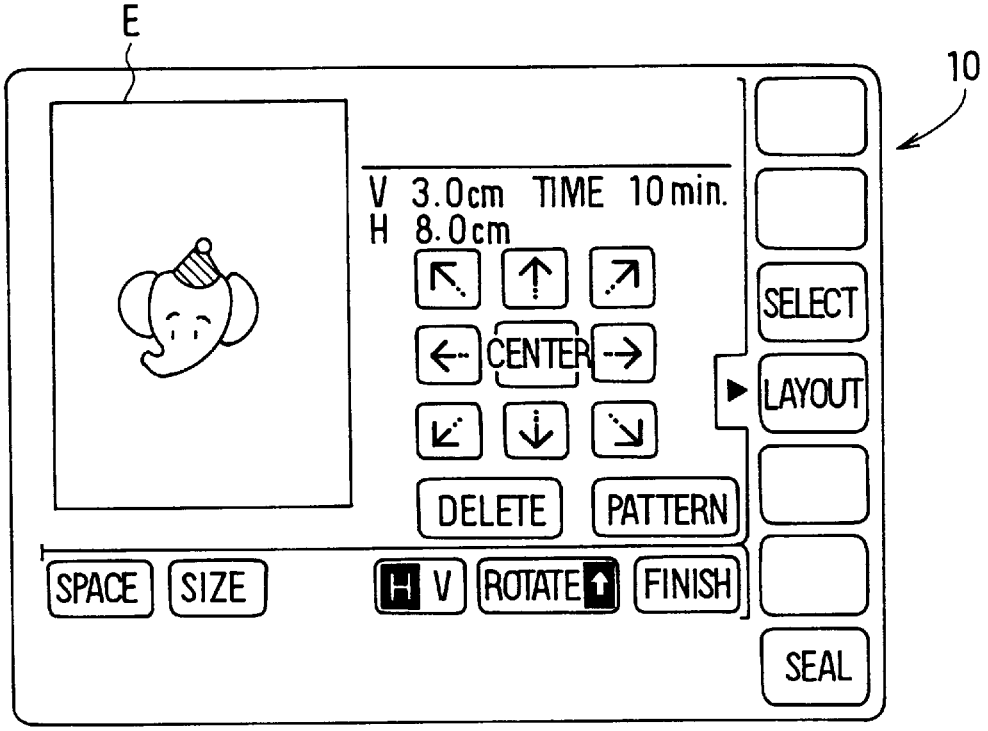
FIG. 12 is a pictorial view showing a screen display for an editing operation.
Figure 13:
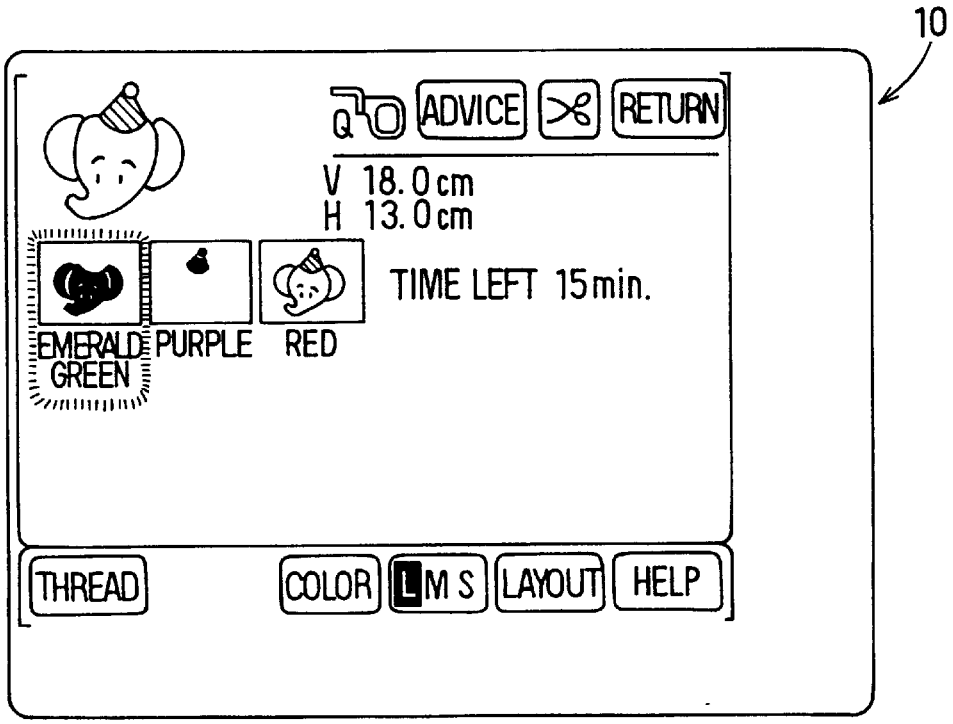
FIG. 13 is a pictorial view showing a screen display of pattern information about an embroidering operation for embroidering a component pattern of a first color.

The pattern data of the first to n-th embroidery patterns are similar. Therefore, more detailed data construction is explained with reference to the first embroidery pattern only. The pattern data of the first embroidery pattern includes pattern display data for displaying a first embroidery pattern and a plurality of color sections of different colors of the first embroidery pattern, stitching data for stitching the first embroidery pattern, and additional information display data for displaying information as screen displays produced when a pattern selecting procedure and an editing procedure as shown in FIGS. 8 to 12 are executed, and for displaying during stitching operation additional information, such as display information including characters, numerals and marks other than the selected embroidery pattern and the component color embroidery sections of the selected embroidery pattern as shown in FIG. 13. The display data area for storing the additional information display data constitutes another display data memory.

Figure 11:
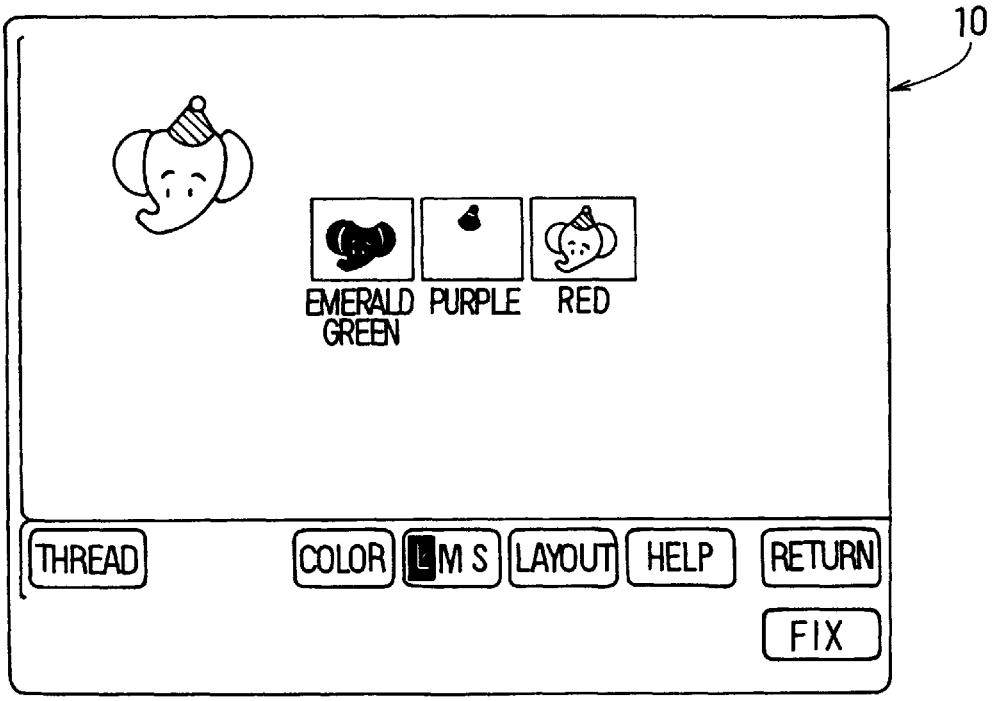
FIG. 11 is a pictorial view showing a screen display of a pattern and component color patterns of the pattern.

If the first embroidery pattern is, for example, an elephant embroidery pattern as shown in FIG. 11, the pattern display data of the first embroidery pattern includes bit data of first to third component color sections and bit data (dot data) of rectangular frames surrounding the component color sections.

The stitching data of, for example, an embroidery pattern consisting of three component color sections of different colors includes stitching data for stitching the three component color sections. The additional information display data includes display data of characters and function names to be displayed as various screen displays. The stitching data of the component color sections includes time periods necessary respectively for embroidering the component color sections.

Figure 4:
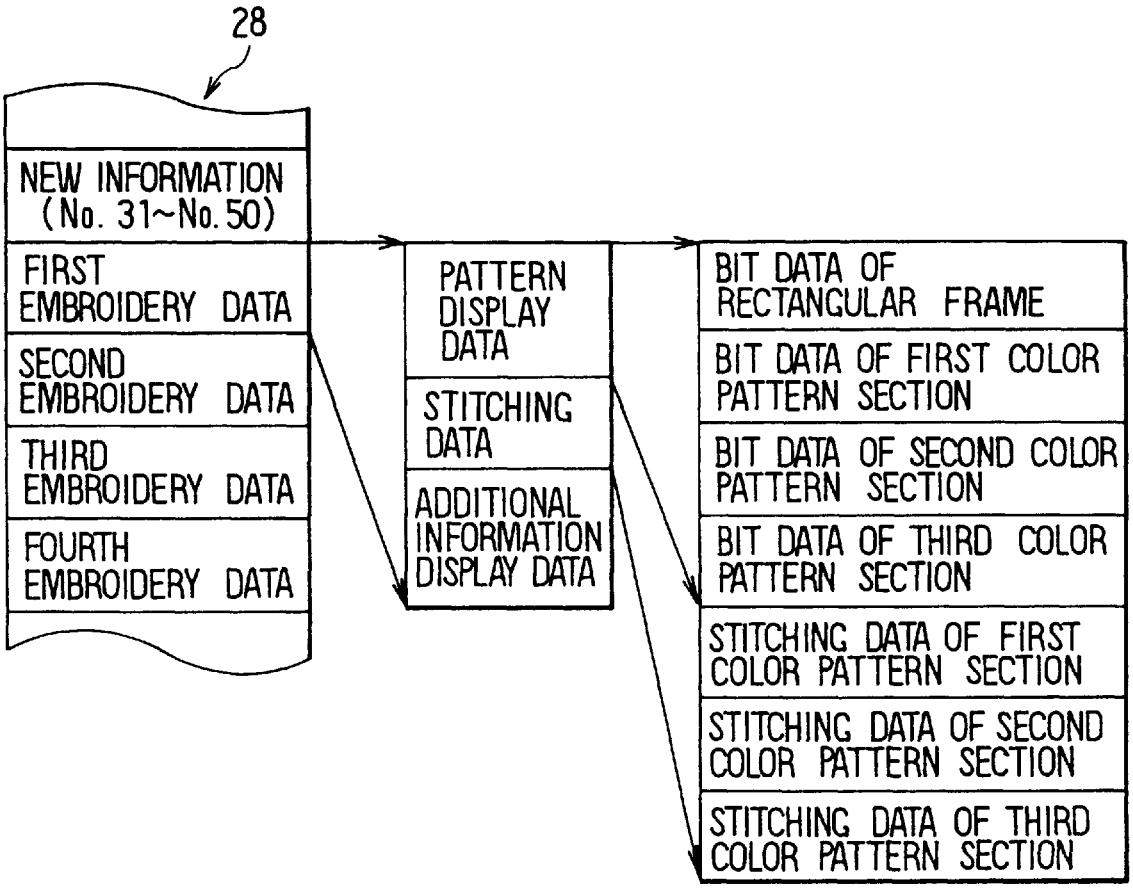
FIG. 4 is a schematic view showing the structure of data stored in a ROM card.

Each ROM 28 of the ROM card 27 usable externally through the slot 2*a* stores therein data of different embroidery patterns. In the same manner as the built-in ROM 24, the ROM 28 stores pattern data of relatively less-frequently used embroidery patterns (a first embroidery pattern, a second embroidery pattern, a third embroidery pattern, . . . , and an n-th embroidery pattern). In addition, as shown in FIG. 4, the ROM 28 stores display data of about twenty display frames (No. 31 to No. 50) which may be new guide information about the latest embroidery patterns, embroidery patterns to be put on the market in the near future and new optionally available auxiliary devices for use in combination with the embroidery device 30. The storage area for storing display data of the new information about the latest embroidery patterns and optionally available auxiliary devices constitute a still another display data memory.

The RAM 25 includes memories necessary for machine control operations, i.e., memories for storing flags, pointers, counters, registers and buffers.

Figure 5:
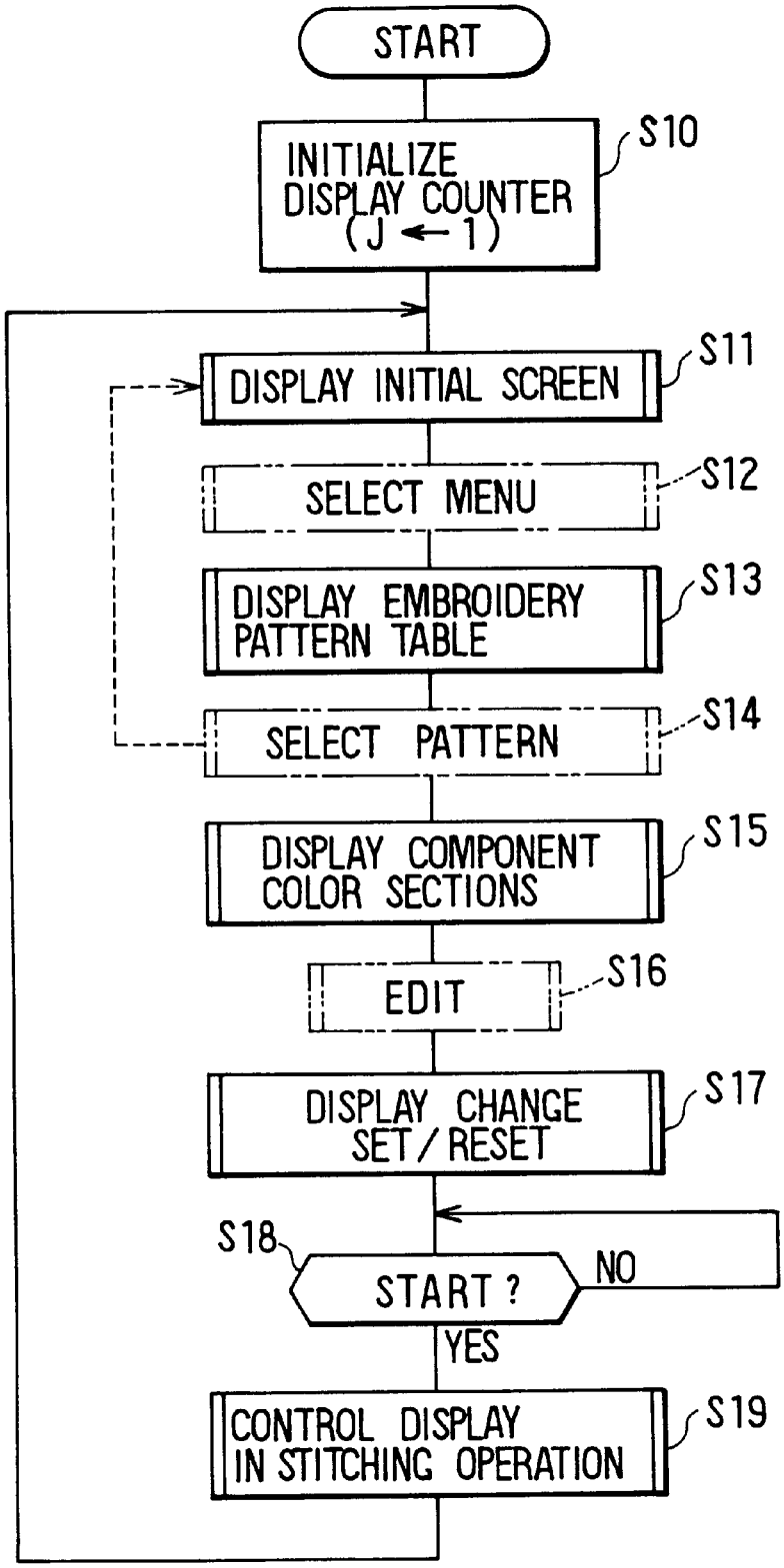
FIG. 5 is a flow chart showing a display control procedure.

The controller C, particularly the CPU 23, executes a display control procedure shown in FIG. 5, in which marks Si (i=10, 11, 12, . . . ) represent steps of the display control.

Figure 8:
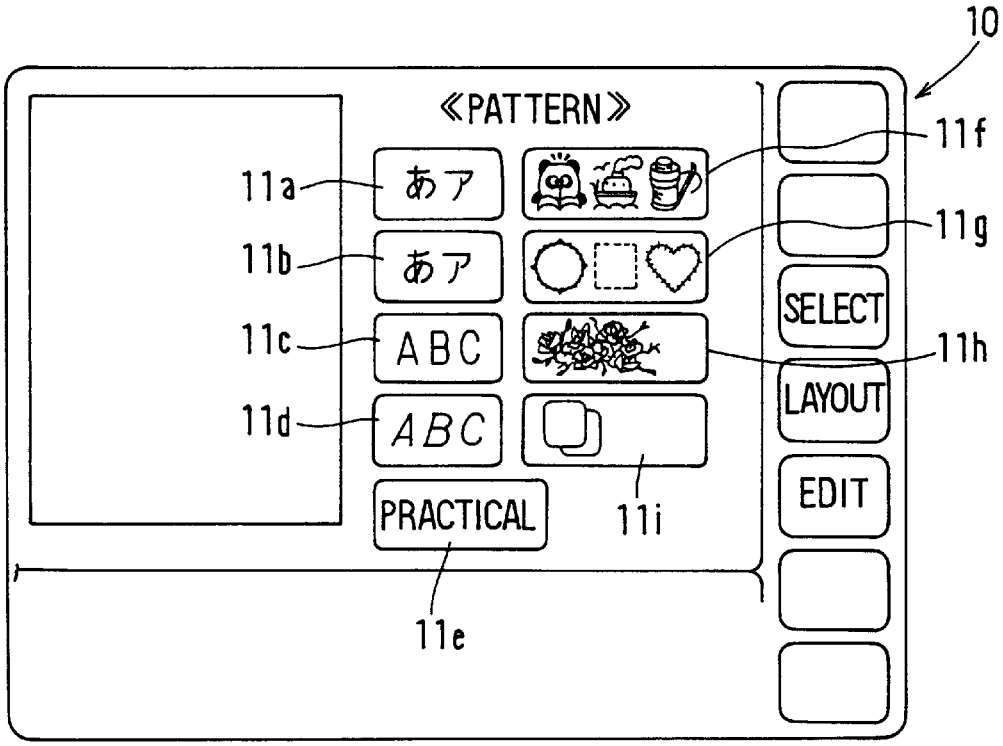
FIG. 8 is a pictorial view showing a screen display for pattern selection.
Figure 9:
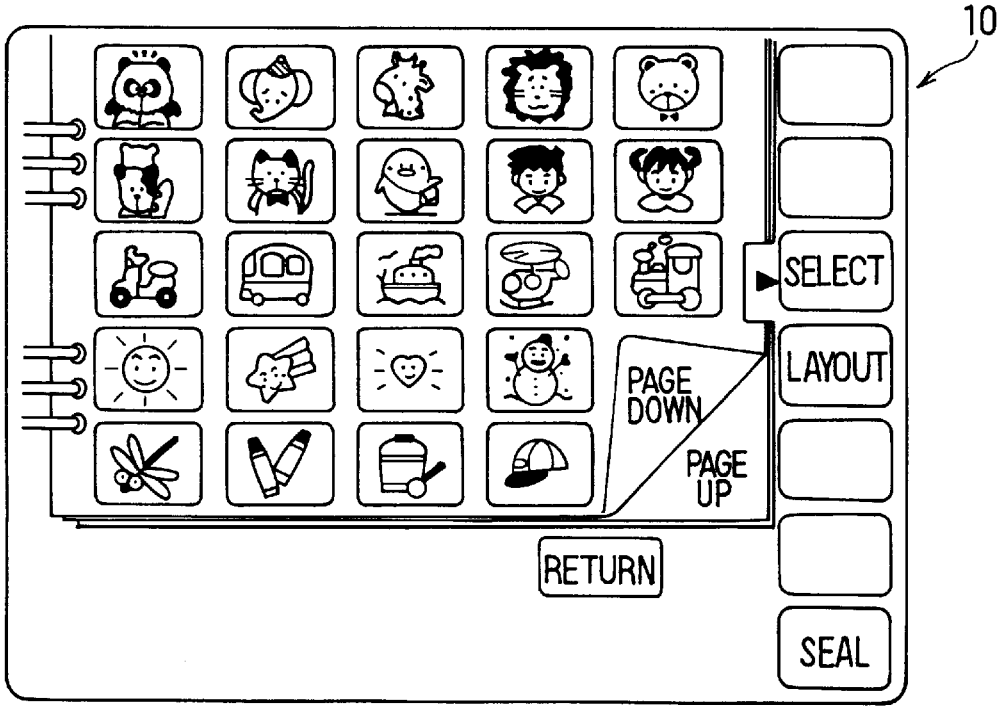
FIG. 9 is a pictorial view showing a screen display of embroidery patterns.

The display control procedure starts upon the connection of the machine M to a power source through a power switch (not shown). A display counter is initialized and count J on the display counter is set to "1" in step S10. An initial screen for the selection of the type (class) of an embroidery pattern is displayed on the display 10 in step S11. The initial screen includes, as shown in FIG. 8, touch keys 11, i.e., selection keys 11*a* to 11*d* for selecting a character pattern by style, a practical pattern selecting key 11*e* for selecting a practical pattern, pictorial pattern selecting keys 11*f* to 11*h* for selecting a pictorial pattern, and a card selecting key 11*i* for selecting an embroidery pattern stored in the ROM card 27 inserted in the slot 2*a* of the machine M. In step S12, a menu selecting procedure for selecting a desired embroidery pattern group is executed when the touch key 11 corresponding to the desired embroidery pattern group is operated, and then a table of a plurality of embroidery patterns included in the selected embroidery pattern group is displayed in step S13. For example, when the touch key 11*f* is operated to select an animal/vehicle embroidery pattern group, an embroidery pattern table of animals and vehicles is displayed as shown in FIG. 9. A plurality of pages of the table can be searched for a desired embroidery pattern by operating marks "PAGE UP" and "PAGE DOWN".

Figure 10:
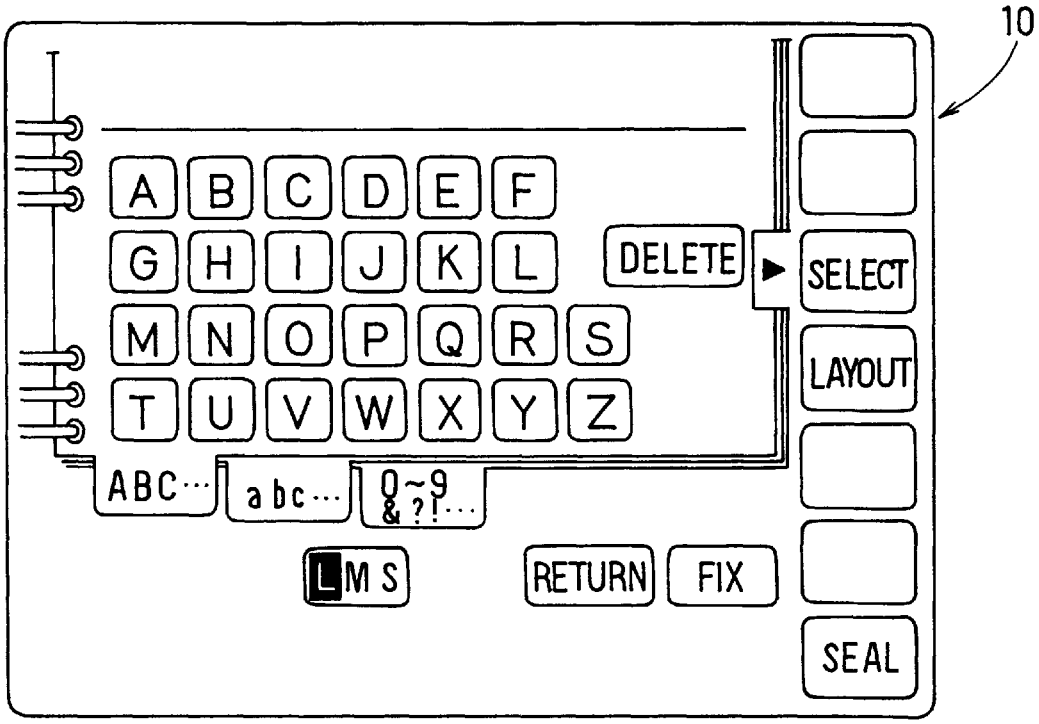
FIG. 10 is a pictorial view showing a screen display of characters and strings of characters.

If one of the selecting keys 11*a* to 11*d* is operated to select a character pattern, a character pattern selecting screen is displayed as shown in FIG. 10.

When the touch key 11 is operated to execute a pattern group selecting process for selecting one of the pattern groups, the embroidery pattern number of the selected embroidery pattern (or the character pattern number of the selected character pattern) is stored in the selected pattern number memory of the RAM 25 in step S14, and the component color sections of the embroidery pattern are displayed in step S15. If the touch key 11 for "RETURN" is operated, the procedure returns to step S11 to display the initial screen. For example, when "Elephant" is selected, an embroidery pattern of elephant, and three component color sections of the embroidery pattern are displayed on the display 10 as shown in FIG. 11.

When a FIX key is operated to fix an embroidery pattern to be embroidered, an editing screen is displayed on the display 10. An editing process for determining the position and size of the embroidery pattern is executed in step S16. For example, as shown in FIG. 12, a rectangular frame E defining an embroidering region is displayed on the display 10 and the selected embroidery pattern, i.e., the elephant embroidery pattern, is shown in the rectangular frame E. Shown also on the display 10 are eight move keys (keys marked with arrows) for moving the position of the embroidery pattern in eight directions in the rectangular frame E, and function names including a turning function key (rotate) for turning the embroidery pattern by an angle of 90° and a pattern changing function key for changing the size of the embroidery pattern on the workpiece W. The editing process is a generally known process and any suitable known editing process may be employed.

In step S17, a display change setting/resetting process for setting or resetting a display changing process during the embroidering operation is executed. In the display change setting/resetting process, a display change flag is set and reset alternately when a display change setting key, not shown, is operated repeatedly. If the display change flag is set, a display change control operation is executed.

Figure 6:
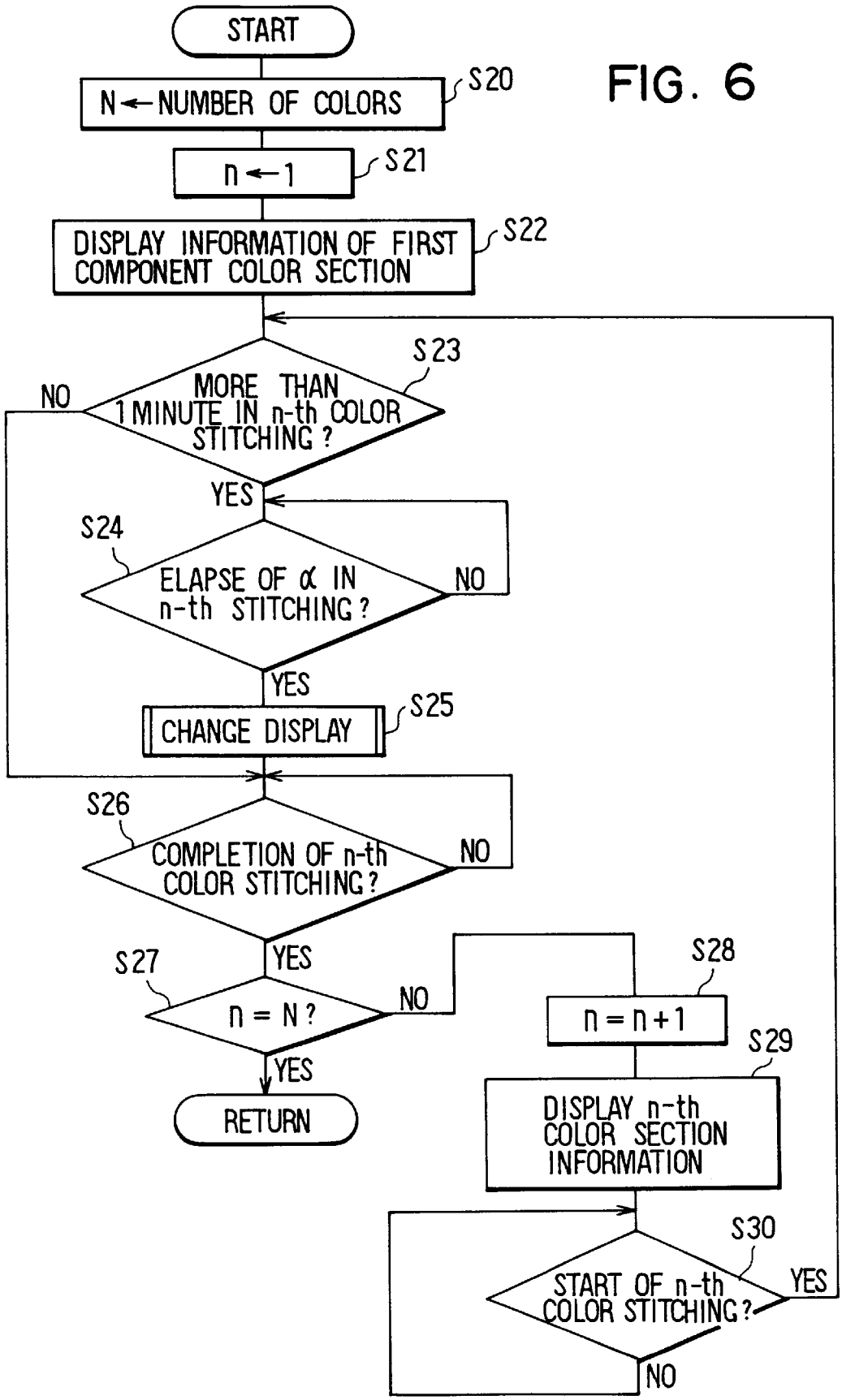
FIG. 6 is a flow chart showing a display control procedure to be executed during a stitching operation.

If the workpiece W is then set on the embroidery frame 34 and the start/stop switch 12 is operated to start an embroidering operation, a determination at step S18 results in affirmative (YES) in step S18. In the next step S19, a stitching control program is started, a command to start a stitching operation is issued, and a display control procedure shown in FIG. 6 is executed.

It is to be noted that, in the stitching process, stitching data specified by the selected pattern number is developed for each of the component color sections, and the developed stitching data of each component color section is stored in the data memory of the RAM 25. The stitching data of the component color sections is read sequentially so that the sewing machine motor 17 as well as the first stepping motor 32 and the second stepping motor 33 of the embroidery device 30 are driven and controlled based on the sequentially read stitching data to execute the stitching process.

When the display control process in the stitching operation is started, the count N of a color counter, i.e., the total number of colors ("3" in this instance) necessary for forming the selected embroidery pattern, is set in step S20, and the count n of a stitch color counter is set to "1" in step S21. Pattern stitching information, i.e., information to be displayed during stitching operation, about embroidering a first component color section is displayed in step S22. For example, a component color section of "emerald green", i.e., the first component color section, is flickered as shown in FIG. 13 to indicate that the first component color section is being embroidered. If an embroidering operation for embroidering an n-th (first in this instance) component color section takes more than one minute, i.e., the determination in step S23 is affirmative, and the time elapsed from the start of the embroidering operation for embroidering the n-th (first in this case) component color section is less than a time α, such as 20 seconds, i.e., the determination in step S24 is negative (NO), step S24 is repeated. Thus, the pattern information about the embroidering operation for embroidering the first component color section as shown in FIG. 13 is displayed continuously.

Figure 7:
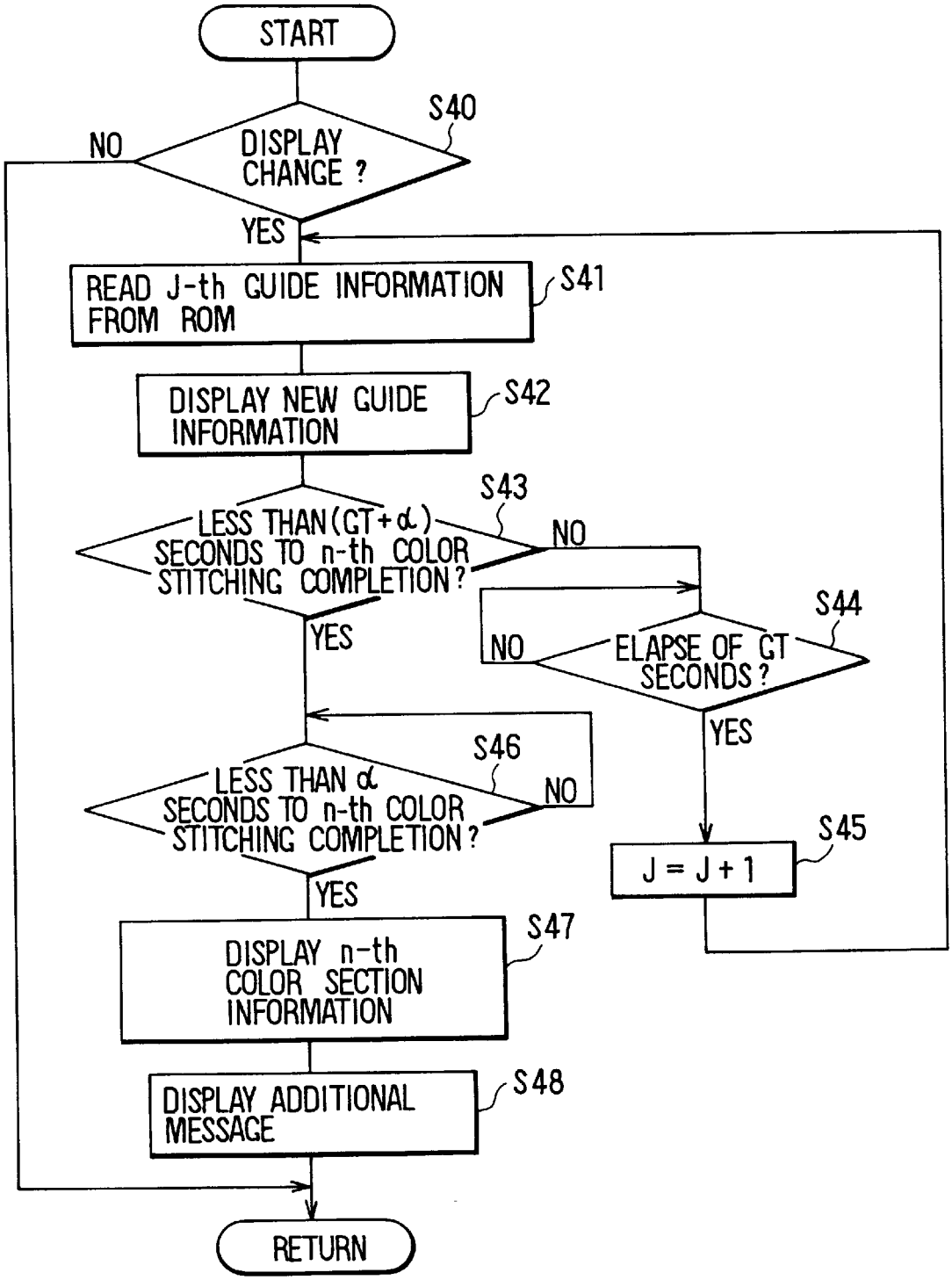
FIG. 7 is a flow chart showing a display changing operation control procedure.

Upon the increase of the elapsed time to the time α, i.e., the determination in step S24 is affirmative, the display change control operation (FIG. 7) is executed in step S25. If the display change flag selected in step S17 is not set, i.e., the determination in step S40 is negative, the display change control operation is ended immediately after the display change control operation is started and the procedure returns to step S26. If the display change flag is set to request a change from the existing screen display to the next screen display, i.e., the determination in step S40 is affirmative, J-th guide information specified by the display count J is read from the ROM 24 or 28 in step S41, and the new guide information is displayed on the display 10 in step S42.

Figure 14:
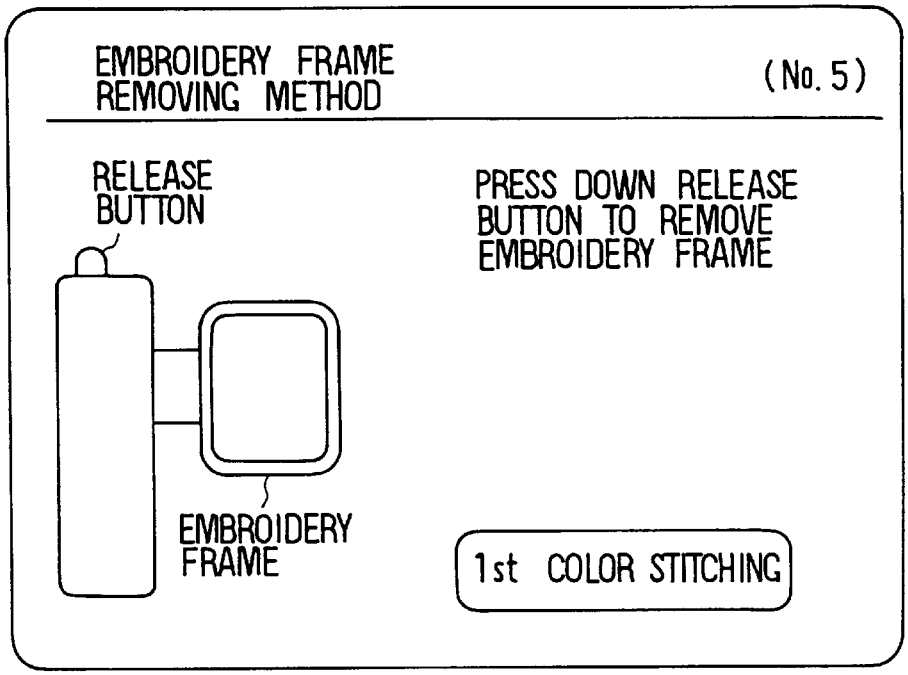
FIG. 14 is a pictorial view showing a screen display of a piece of guide information illustrating a method of removing an embroidery frame.
Figure 15:
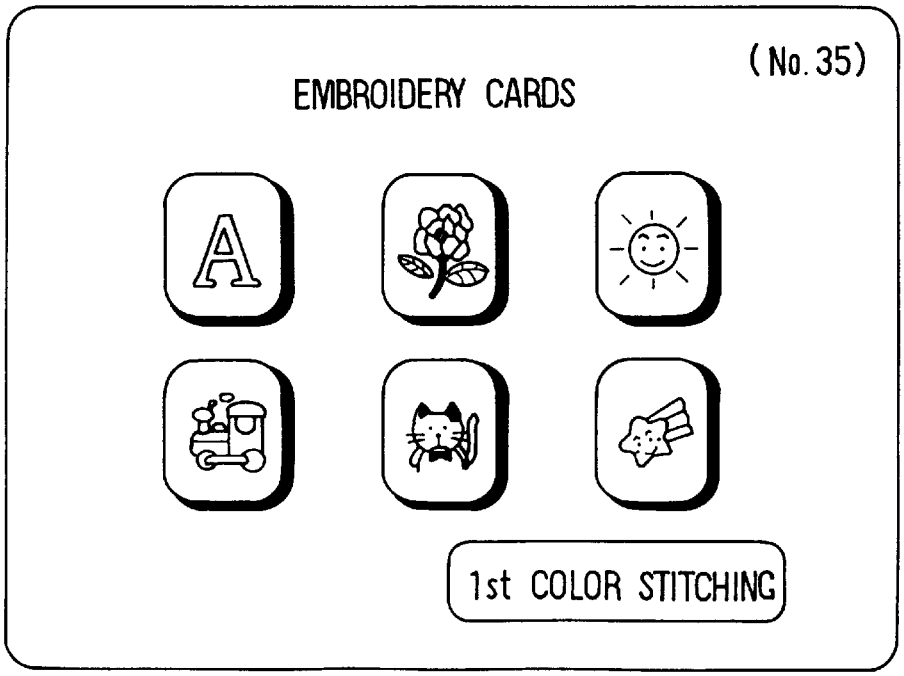
FIG. 15 is a pictorial view showing a screen display of a piece of guide information illustrating new patterns.
Figure 16:
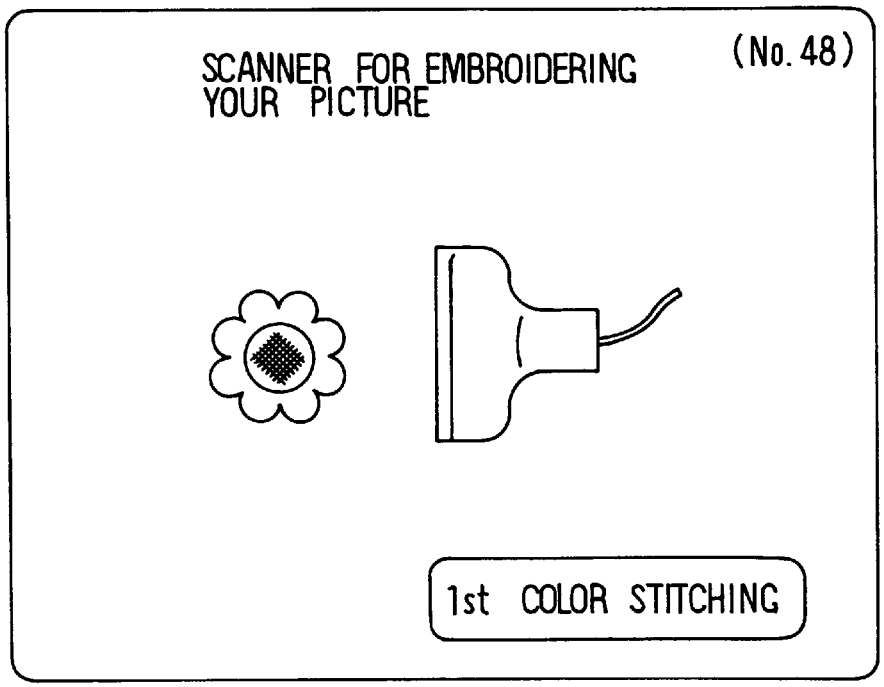
FIG. 16 is a pictorial view showing a screen display of a piece of guide information illustrating an optionally available auxiliary device usable in the embodiment shown in FIG. 1.

For example, if the display count J is "5", embroidery device 30 using method No. 5, "EMBROIDERY FRAME REMOVING METHOD" as shown in FIG. 14 among the thirty frames illustrating pieces of guide information is read from the ROM 24, and displayed on the display 10. If the ROM card 27 is inserted in the slot 2*a* and the display count J is "35", guide information about new embroidery patterns is read from the ROM 28, and a screen display of a plurality of new patterns including ornamented characters and flowers are displayed on the display 10 as shown in FIG. 15. If the display count J is "48", a screen display of an optionally available auxiliary device which can be used in combination with the embroidery device 30, such as a handy scanner is displayed on the display 10 as shown in FIG. 16. In each display of the guide information, the number (first in this instance) of component color section being currently performed is also displayed as shown in FIGS. 14 to 16.

If the time remaining until the completion of embroidering the n-th (first in this instance) component color section is longer than or equal to a predetermined time which is the sum of a guide information display time GT and an n-th component color section information display time α, i.e., if the determination in step S43 is negative, and present guide information display time is shorter than the guide information display time GT, i.e., the determination in step S44 is negative, step S44 is executed again to continue displaying the guide information displayed at present. Upon the reach of the guide information display time to the predetermined guide information display time GT, i.e., if the determination in step S44 is affirmative, the display count J is incremented by "1" in step S45, and then steps S41–S45 are repeated.

Figure 17:
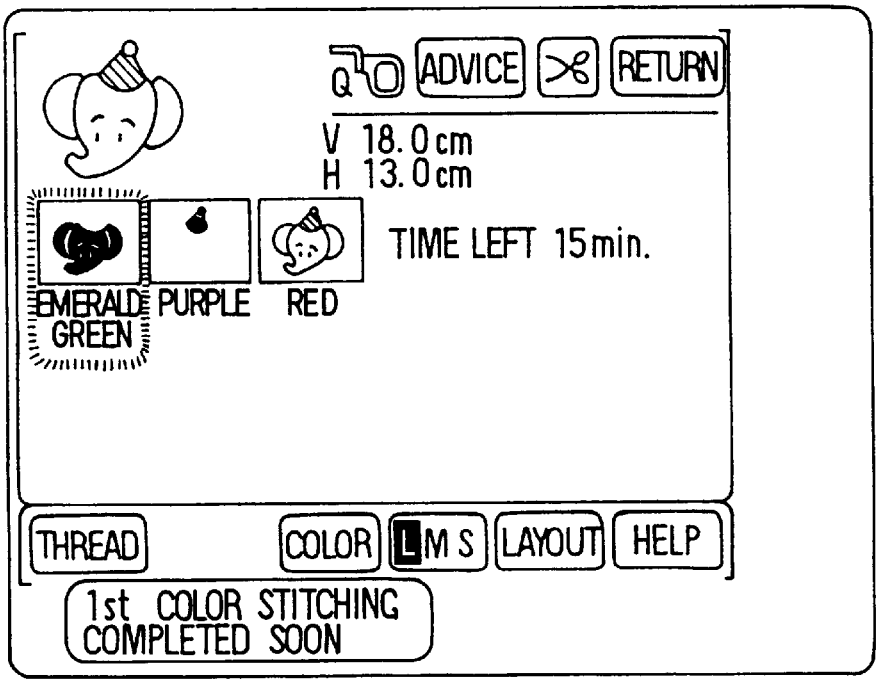
FIG. 17 is a pictorial view, corresponding to FIG. 13, showing a screen display produced at the completion of the embroidering operation for embroidering a pattern of a first color.

If the time remaining until the completion of embroidering the n-th component color section is within the predetermined time GT+α, i.e., if the determination in step S43 is affirmative, the next step S46 is repeated to continue displaying the guide information displayed at present until the time remaining until the completion of embroidering the n-th component color section becomes less than the n-th component color section information display time α. If the time remaining until the completion of embroidering the n-th component color section is less than the n-th component color section information display time α, i.e., the determination in step S46 is affirmative, the information about the n-th (first in this instance) component color section is displayed again on the display 10 in step S47, and an additional message, "n-th COLOR STITCHING COMPLETED SOON" is displayed on the display 10 in step S48 as shown in FIG. 17, and then the procedure returns to step S26.

When the sewing machine motor 17 is stopped at the completion of embroidering the n-th component color section, i.e., the determination in step S26 is affirmative, and the color count n ("1" in this instance) is less than the total color count N ("3" in this instance), i.e., the determination in step S27 is negative, the color count n is incremented by "1" in step S28 and pattern information about the next component color section is displayed in step S29. When the start/stop switch 12 is operated to start another embroidering operation for embroidering the next component color section, i.e., the determination in step S30 is affirmative, the steps S23–S30 and S40–S48 are repeated for each component color section. If the sewing machine motor 17 is stopped and the embroidering operation for embroidering the last (third in this instance) component color section is completed, i.e., the determination in step S27 is affirmative, the control is ended and the procedure returns to step S11 to execute the display control procedure. It is to be noted that, if the total number N of component color section is "1", the above control ends in step S27 without executing steps S28 to S30.

As described above, the ROM 24 of the controller C is provided with a display memory area for storing display data for displaying the embroidery device using methods, and a display memory area for storing additional information display data for displaying additional information, such as display information to be displayed during the embroidering operation. The ROM 28 of the ROM card 27 is provided also with a display memory area for storing display data for displaying information about new embroidery patterns and optionally available auxiliary devices.

Further, during the embroidering operation for embroidering each component color section using a color thread, ordinary display information to be displayed during the embroidering operation is displayed on the display 10, and pieces of the guide information about the embroidery device using method, new embroidery patterns and optionally available auxiliary devices are displayed sequentially as the plurality of frames at predetermined intervals equal to the predetermined guide information display time GT. Since the various pieces of the guide information different from the ordinary display information to be displayed during the embroidering operation are thus displayed sequentially, the operator is able to acquire various pieces of information while the embroidering operation is in progress and is able to enjoy embroidering.

Since the ordinary display information to be displayed during the embroidering operation is displayed for the n-th component color section information display time $\alpha$ after the start of the embroidering operation for embroidering each component color section, various pieces of information including information about the stitching time and the color of the thread being used can be acquired from the information displayed for the display time $\alpha$ after the start of the embroidering operation.

Since the display information to be displayed during the embroidering operation is displayed again from the predetermined time point where the n-th component color section information display time $\alpha$ remains before the completion of the embroidering operation for each component color section, it is informed to the operator that the embroidering operation for embroidering the component color section will soon be completed and a color thread for embroidering the next component color section can be prepared beforehand, thus enabling a quick color thread changing operation.

Since the ROM 28 of the ROM card 27 is provided with the display memory areas for storing display data for displaying information about new embroidery patterns and optionally available auxiliary devices, the embroidery patterns stored in the ROM card 27 can be stitched and guide information read from the ROM card 27 can be displayed if the ROM card 27 is inserted in the slot 2*a* of the machine M. The latest guide information can be acquired by procuring new ROM cards 27, and the latest guide information can be displayed on the display 10.

In the foregoing embodiment, the n-th component color section information display time $\alpha$ and the guide information display time GT may be an optional length of time. The guide information stored in the ROM 24 may include an instruction for operating the machine M, an instruction for cleaning the machine M, an instruction for inspecting the machine M and various pieces of guide information about the embroidering operation. Although the pattern data of each embroidery pattern employed in the above embodiment includes the stitching data and the pattern display data, the pattern display data can be produced by processing the stitching data if the pattern data includes only the stitching data. The display 10 may be a CRT display. A magnetic disk may be used instead of the ROM card 27 for storing the pattern data, and the controller C may be provided with a floppy disk drive mechanism to read data from the magnetic disk. A compact disk, a CD-ROM or a magneto-optical disk may be used instead of the ROM card 27.

Although the invention has been described in its preferred form with a certain degree of particularity, obviously many changes and variations are possible therein. It is therefore to be understood that the present invention may be practiced otherwise than as specifically described herein without departing from the scope and spirit thereof.

I claim:

1. A sewing and embroidering machine comprising:

a pattern data storage medium storing pattern data of a plurality of embroidery patterns to be selected;

a display device;

an embroidering device for stitching a selected one of the embroidery patterns on a workpiece;

a stitching control unit for driving and controlling the embroidering device based on the pattern data of the selected one of the embroidery patterns;

a first display data storage medium storing display information to be displayed on the display device during a stitching operation;

a second display data storage medium storing guide information about embroidering to be displayed on the display device during the stitching operation; and a display data change control unit for changing, during a stitching operation of the selected one of the embroidery patterns, a display on the display device automatically according to a predetermined condition between the display information stored in the first display data storage medium and the guide information stored in the second display data storage medium.

2. The machine according to claim 1, wherein:

the second display data storage medium stores, as the guide information, information about methods of operating the embroidering device and information introducing embroidery patterns.

3. The machine according to claim 1, wherein:

the second display data storage medium stores the guide information as a plurality of images; and the display data change control unit controls the display device to display the plurality of images of the guide information sequentially at predetermined time intervals.

4. The machine according to claim 1, further comprising:

an external memory receiving device for receiving therein an external memory as the second display data storage medium, the external memory being capable of loading, unloading and storing therein pattern data of a plurality of embroidery patterns different from the embroidery patterns stored in the pattern data storage medium.

5. The machine according to claim 1, wherein:

each of the embroidery patterns of the pattern data storage medium includes a plurality of component color sections; and the display data change control unit changes the display in a stitching operation of each of the component color sections of the selected one of the embroidery patterns.

6. The machine according to claim 5, wherein:

the display data change control unit controls the display device to start displaying the display information for a predetermined time after a start of the stitching operation of each of the component color sections of the selected one of the embroidery patterns and then switch to displaying the guide information.

7. The machine according to claim 5, wherein:

the display data change control unit controls the display device to display the display information for a predetermined time just before a completion of the stitching operation of each of the component color sections of the selected one of the embroidery patterns.

8. The machine according to claim 5 wherein:

the display data change control unit controls the display device to start displaying the display information for a first predetermined time after a start of the stitching operation of each of the component color sections of the selected one of the embroidery patterns and then switch to displaying the guide information; and the display data change control unit controls the display device to display the display information for a second predetermined time just before a completion of the stitching operation of each of the component color sections.

9. The machine according to claim 8, wherein:

the second data storage medium stores the guide information as a plurality of images; and the display data change control unit controls the display device to display the plurality of images of the guide information sequentially at predetermined time intervals between the first predetermined time and the second predetermined time.

10. The machine according to claim 9, wherein:

the second display data storage medium is an external memory storing, as the guide information, at least one of information introducing embroidery patterns and optionally available devices, the external memory being connectable to and disconnectable from the stitching control unit and the display data change control unit.

11. An embroidery device control process comprising the steps of:

selecting one of a plurality of embroidery patterns from a data storage medium;

starting a stitching operation of the selected one of the embroidery patterns;

starting a display of first information related to the started stitching operation; and changing the display of the first information to a display of second information different from the first information after an elapse of a predetermined time from a start of the stitching operation of the selected one of the embroidery patterns, wherein the second information is guide information about embroidering other than the started stitching operation.

12. An embroidery device control process comprising the steps of:

selecting one of a plurality of embroidery patterns from a data storage medium;

starting a stitching operation of the selected one of the embroidery patterns;

starting a display of first information relating to the started stitching operation; and changing the display of the first information to a display of second information different from the first information after an elapse of a predetermined time from a start of the stitching operation of the selected one of the embroidery patterns, wherein each of the plurality of embroidery patterns includes a plurality of component color sections;

the stitching operation starting step, the display starting step and the display changing step are executed in a stitching operation of each of the component color sections of the selected one of the embroidery patterns; and the display changing step changes the display of the second information to the display of the first information before an end of the stitching operation of each of the component color sections of the selected one of the embroidery patterns.

13. The control process according to claim 11, further comprising the step of:

displaying sequentially a plurality of different images each forming a part of the second information after the display of the first information is changed to the display of the second information.

14. The control process according to claim 13, further comprising the step of:

reading information from an external memory as the second information to display the read information sequentially in the sequential displaying step, the external memory being different from the data storage medium.

15. A sewing and embroidering machine comprising:

means for selecting one of a plurality of embroidery patterns from a data storage medium;

means for starting a stitching operation of the selected one of the embroidery patterns;

means for starting a display of first information related to the started stitching operation; and means for changing the display of the first information to a display of second information different from the first information after an elapse of a predetermined time from a start of the stitching operation of the selected one of the embroidery patterns, wherein the second information is guide information about embroidering other than the started stitching operation.

16. A sewing and embroidering machine comprising:

means for selecting one of a plurality of embroidery patterns from a data storage medium;

means for starting a stitching operation of the selected one of the embroidery patterns;

means for starting a display of first information related to the started stitching operation; and means for changing the display of the first information to a display of second information different from the first information after an elapse of a predetermined time from a start of the stitching operation of the selected one of the embroidery patterns, wherein each of the plurality of embroidery patterns includes a plurality of component color sections; and the stitching operation starting means, the display starting means and the display changing means execute respective operations in a stitching operation of each of the component color sections of the selected one of the embroidery patterns.

17. The machine according to claim 16, further comprising:

means for changing the display of the second information to the display of the first information before an end of the stitching operation of each of the component color sections of the selected one of the embroidery patterns.

18. The machine according to claim 16, further comprising:

means for displaying sequentially a plurality of different images each forming a part of the second information after the display of the first information is changed to the display of the second information.

19. The machine according to claim 16, further comprising:

means for reading information from an external memory as the second information to display the read information sequentially in the sequential displaying means, the external memory being different from the data storage medium.

20. A data storage medium for storing therein at least two kinds of display information which are displayed selectively and automatically, according to a predetermined condition, on a display device of a sewing and embroidering machine, the at least two kinds of display information comprising:

embroidery pattern data to be displayed on the display device and stitched by the machine;

guide information to be displayed on the display device of the machine; and a program for changing, during a stitching operation by the machine, a display on the display device between the at least two kinds of display information selectively and automatically according to the predetermined condition.

21. The data storage medium according to claim 20, wherein:

the data storage medium is an external memory which is attachable to and removable from the machine.

22. A data storage medium for a sewing and embroidering machine with a display device, the data storage medium storing:

a program for changing, during a stitching operation, a display on the display device between at least two kinds of display information automatically according to a predetermined condition, wherein the two kinds of information include information of embroidery patterns to be embroidered and information of guiding embroidering other than the embroidery patterns.

23. The data storage medium according to claim 22, wherein:

the program includes a step of changing the display on the display device after an elapse of a predetermined time from a start of the stitching operation.

24. The data storage medium according to claim 22, wherein:

the program includes a step of changing the display on the display device immediately before an end of the stitching operation.

25. The data storage medium according to claim 22, wherein:

the program includes a step of changing the display on the display device irrespective of manual operation of an operator on the machine.

26. A sewing and embroidering machine comprising:

means for selecting one of a plurality of embroidery patterns from a data storage medium;

means for starting a stitching operation of the selected one of the embroidery patterns;

means for starting a display of first information related to the started stitching operation; and means for changing the display of the first information to a display of second information different from the first information, wherein each of the plurality of embroidery patterns includes a plurality of component color sections, the stitching operation starting means and the display starting means execute respective operations in a stitching operation of each of the component color sections of the selected one of the embroidery patterns, and the operation of the display changing means depends on a time of the stitching operations of each of the component color sections of the selected one of the embroidery patterns.

* * * * *